United States Patent [19]

Arntzen

[11] 4,341,401

[45] Jul. 27, 1982

[54] METHOD AND APPARATUS FOR COVERING BOOKS

[76] Inventor: Huguette C. Arntzen, 1 Av. Franklin Roosevelt, 1050 Brussels, Belgium

[21] Appl. No.: 120,221

[22] Filed: Feb. 11, 1980

Related U.S. Application Data

[63] Continuation-in-part of Ser. No. 730,732, Oct. 8, 1976, abandoned.

[30] Foreign Application Priority Data

Oct. 9, 1975 [BE] Belgium ..... 834335

[51] Int. Cl.[3] ..... B42C 15/00; B42D 3/00

[52] U.S. Cl. ..... 281/34; 402/3; 412/4

[58] Field of Search ..... 281/34, 1; 402/3; 11/1 R

[56] References Cited

U.S. PATENT DOCUMENTS 3,297,347 1/1967 Reed et al. ..... 281/34

FOREIGN PATENT DOCUMENTS 807264 1/1937 France .
2048098 3/1971 France .
16264 of 1905 United Kingdom ..... 281/34
460784 2/1937 United Kingdom ..... 281/34
908525 10/1962 United Kingdom ..... 281/34

*Primary Examiner*—Paul A. Bell
*Attorney, Agent, or Firm*—Wender, Murase & White

[57] ABSTRACT

Book coverings for protecting and improving the aesthetic appearance of books of varying sizes in which an outer wrapping sheet, which may be opaque or transparent, is cut or folded to conform to the height of the book leaving end flaps for the front and rear covers, and wherein generally elongated leaflets are provided to be cut to a dimension slightly greater than the height of the book for attachment to the outer surface of the front and back cover portions of the wrapper adjacent the end flap to form a loop on the inside of the book cover, the end flap being tucked under the loop to form a finished cover. The leaflets may be opaque or transparent and may be trapezoidal in shape or rectangular. The covers are positively held by the loops on the books without direct attachment thereto.

25 Claims, 27 Drawing Figures

Fig. 11
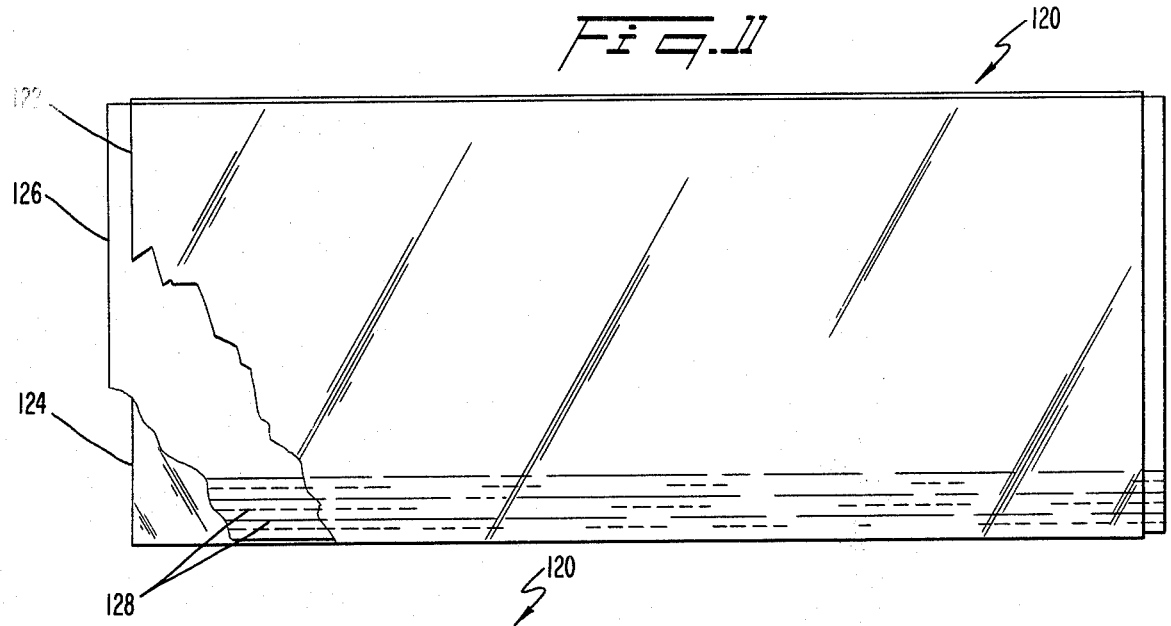
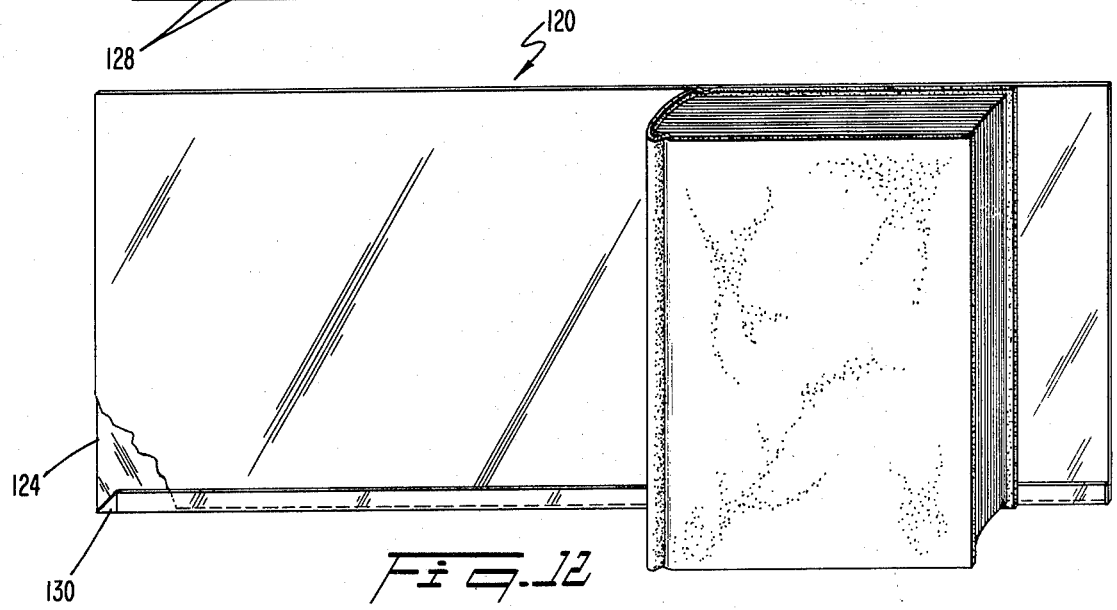
Fig. 12
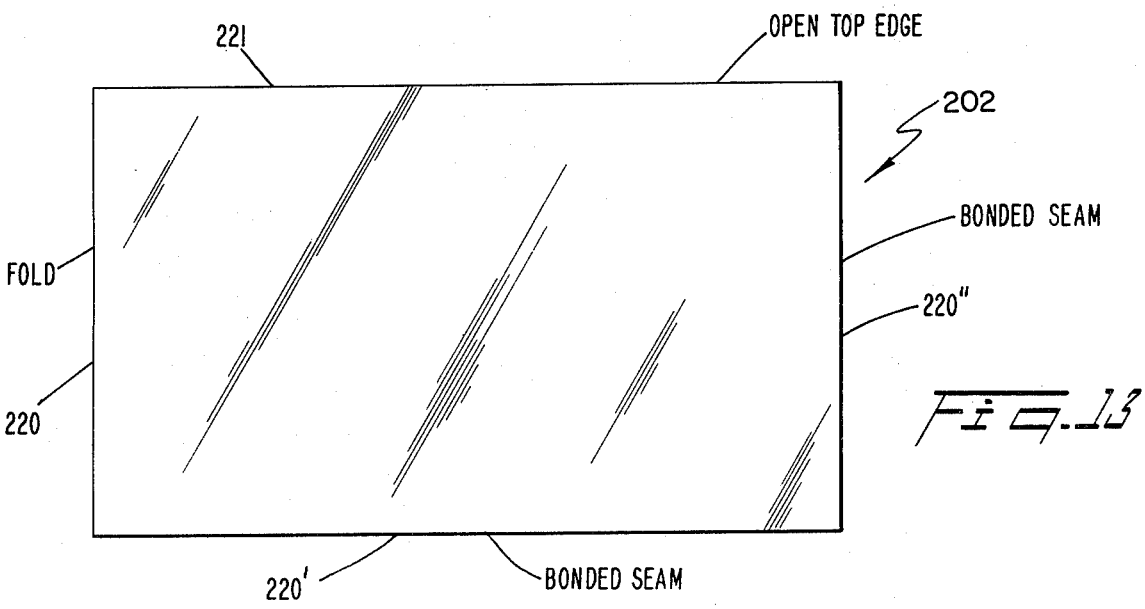
Fig. 13

Fig. 24
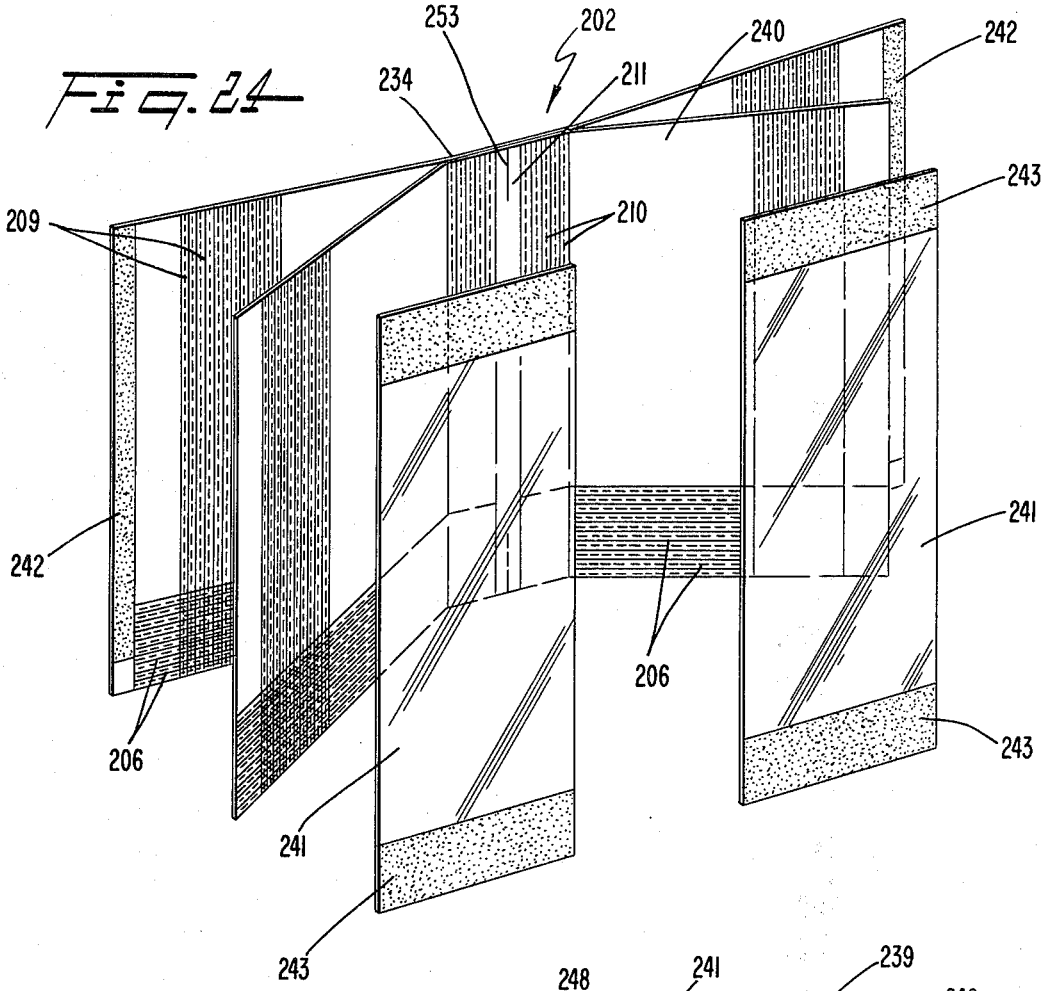
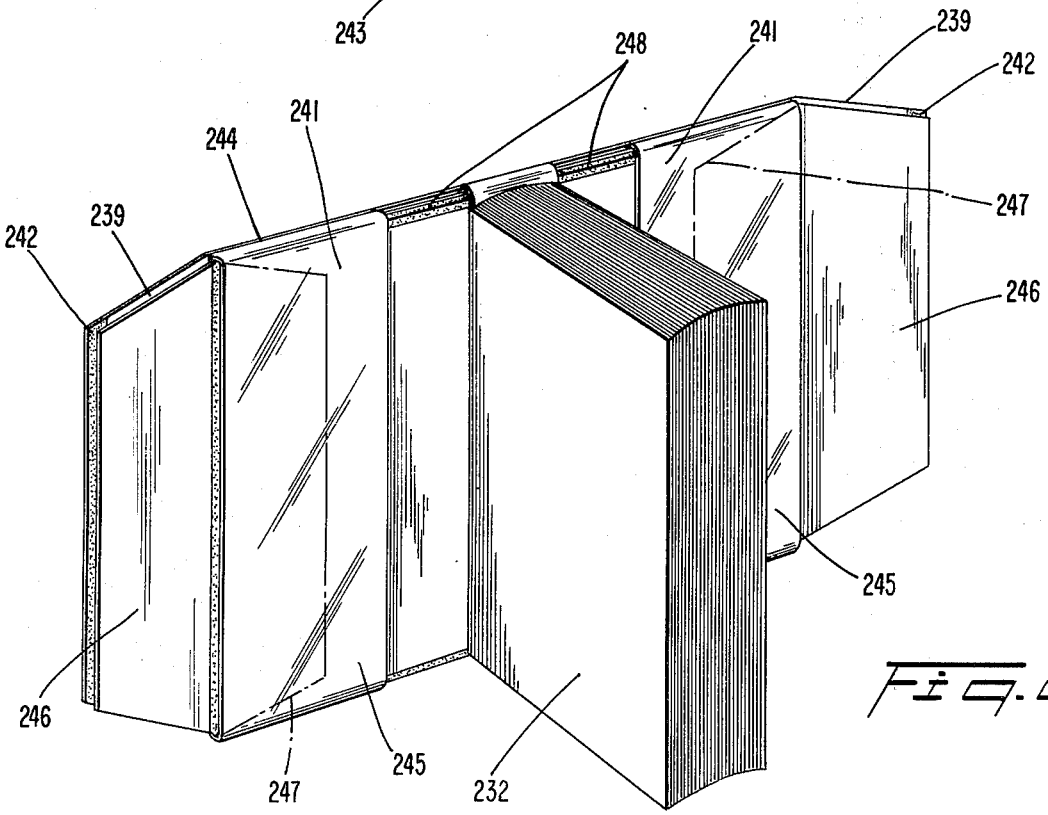
Fig. 25

METHOD AND APPARATUS FOR COVERING BOOKS

CROSS-REFERENCE TO RELATED APPLICATION

This is a continuation-in-part of application Ser. No. 730,732, filed Oct. 8, 1976, now abandoned.

BACKGROUND OF THE INVENTION

1. Field of the Invention

The present invention relates generally to book covers, and more particularly, to improved book covers which may be readily conformed to the height, width and thickness of the book to be covered.

2. Description of the Prior Art

Protective coverings or outer wrappings for books of different dimensions have long been available. Many different techniques have been developed and used, with varying success, in providing both decorative and functional protective wrappings. However, the coverings and covering techniques of the prior art have not always been fully satisfactory, particularly in accommodating books of different height.

The basic procedure for covering a book according to the prior art is to provide a wrapping material which is cut or folded to the height of the book and is wrapped completely therearound. End flaps are then tucked under the front and rear covers thereby covering all exposed surfaces. Such a cover has the obvious disadvantage in being easily displaceable from the book unless some means, such as tape or pressure sensitive adhesive, are provided for directly attaching or affixing the cover to the book. Of course, any such attachment means has its own disadvantage in the potential of damaging the book itself when the book covering has to be replaced.

In order to overcome some of the above-noted disadvantages, prior art methods, as exemplified by the those shown in French Pat. Nos. 2,048,098 and 807,264, have been proposed wherein loops or pockets are provided for receiving the front or rear covers of the book to prevent inadvertent displacement of the cover. However, once a fixed pocket or loop is provided, it becomes impossible to cut or fold the wrapper to accommodate different books of different height. Moreover, the covers are not held tightly in place when the book is open which increases the likelihood that the cover will be torn or otherwise damaged when in use.

SUMMARY OF THE INVENTION

It is, therefore, an object of the present invention to cover a book with a protective and aesthetically pleasing outer covering which is fixed in position without any attachment to the book and which may be readily conformed to books of greatly varying dimensions.

It is another object of the present invention to provide an improved method of covering books in which height, width and thickness dimensions of the book may be accommodated while at the same time providing decorative and/or protective outer wrappings held securely in place without direct attachment to the book itself.

The present invention is summarized as a method and apparatus for covering books which includes, in combination, an outer wrapping sheet and a pair of generally elongated leaflets adapted to be positioned inside the front and rear covers, respectively, of the book adjacent the free edges thereof for attachment to the outer surface of the wrapper so as to form two loops functioning to hold the book cover in place, regardless of the book height, and to receive and securely hold the end flaps of the wrapper.

The present invention also contemplates the use of elongated leaflets of generally trapezoidal shape having several lines parallel to one of the non-parallel sides to indicate where the leaflet is to be cut to conform to the height of the book to be covered.

According to the present invention, a cover or wrapper sheet is provided with location means indicating where the sheet can be folded or cut in order to conform exactly to at least the height, width or thickness of the books to be covered. The cover sheet may be transparent or opaque and may be made of any suitable natural or synthetic material such as paper, cardboard, leather, plastic and the like. In one of the embodiments, the book cover further includes an opaque decorative spine strip attached to the cover sheet.

The present invention also includes the use of transparent wrappers wherein the above-mentioned indication means appears on a supplementary location sheet, which can be thrown away after use. This supplementary location sheet, which is preferably opaque and rectangular, can have indication means along the upper and/or lower lengthwise edges, and a series of parallel horizontal continuous and discontinuous lines to indicate accurately the exact measures of the different possible heights of the books to be covered. The indication means are situated close enough to each other to precisely conform the height of the book cover to the height of the book. When the cover sheet is transparent it can be utilized not only to enclose the location sheet, but also for display purposes. This result is best achieved by effecting a fold in the transparent sheet along a vertical left edge with the sheet then bonded or welded along the inferior edge and along the right vertical edge to form a pocket open at the top to receive the location sheet.

The location sheet can also have, near to its right and/or left lateral edges, a series of vertical parallel continuous and discontinuous lines indicating with accuracy the exact measures of the different possible widths of the books to be covered.

Finally, the location sheet can also have a series of vertical parallel continuous and discontinuous lines extending perpendicularly to the longitudinal edges of the sheet, on both sides of the median vertical center line, this series of lines being arranged to indicate accurately the exact measure of the different possible thicknesses of the books to be covered.

If the cover sheet is opaque, the individual or the different series of parallel lines forming the location means described hereinabove are preferably drawn on the back of the cover sheet; these series of lines can be discontinuous.

The lines forming the above-mentioned series of lines can be separated from each other by about 0.25 cm. Figures or letters can be applied to each line of the series to indicate the distance to a corresponding line of the same series or to another series of lines or to a parallel edge of the sheet on which the series of lines is drawn.

The spine strip according to the present invention can have at least on a portion of one surface, an adhesive or pressure sensitive coating making it possible to fix the strip securely to the cover sheet. In one embodiment of the spine strip, it can be provided on its back surface with a self-adhesive tape to form a flap at least at one of its ends, whereby the flap may be fixed on the front of the cover sheet after having been folded over the edge of the latter.

In another embodiment of the apparatus, according to the invention, there is provided, besides the transparent cover sheet and the opaque spine strip, a support strip fo the spine strip and means to attach the spine strip to the support strip after application of the strips to the cover sheet. The support strip is applied on one of the sides of the cover sheet and the spine strip is applied on the other side or on the same side of the cover sheet. The support strip can be articulated along one of its ends to the spine strip or to the cover sheet and/or provided with an adhesive coat permitting it to adhere to the spine strip and to the cover sheet.

The unit, according to the invention is also characterized by the fact that it includes two rectangular or trapezoidal leaflets which can be either opaque or transparent. The leaflets can be made of paper, plastic or any other suitable material (including the same material as the cover sheet itself), having a height greater than the height of the book to be covered and a width smaller than the width of the book. According to the invention, means are provided to attach the leaflets to the cover sheet, so that the leaflets can form a loop on the back side of the cover sheet immediately adjacent the free edges of the book. This loop positively secures the cover to the book without direct attachment thereto and provides a pocket into which the end flaps can be neatly tucked. The leaflets are preferably covered, on the whole surface of one side or along the upper and/or lower edge portions, with a self-adhesive protective coating to permit the edges of the leaflets to be attached to the cover sheet after folding the exposed leaflet edges over the cover sheet. If the wrapper includes an intermediate sheet, the leaflet edges may be attached thereto rather than to the outer wrapper sheet.

In a modification of the above embodiment, the cover sheet may be provided with a self-adhesive portion along the upper and lower edges so that the leaflets may be made in one piece with the cover. In use, the leaflets first will be cut from the cover whereupon the leaflets and the cover will be of the same material.

In another embodiment of the invention, the unit can also comprise one or two interpolated sheets which can be placed between the cover sheet and the book to be covered. When a single interpolated sheet is used, it is advantageously glued to the cover sheet along a vertical band extending along its central part, whereas, when two interpolated sheets are used, one of the interpolated sheets can be glued to the other sheet along a vertical band extening along the central part of the sheet. The interpolated sheets can be attached to the cover sheet or can be provided with means permitting attachment to the cover sheet. The interpolated sheets can be provided with location lines as described above.

Further, objects and advantages of the present invention will be apparent from the following description of the preferred embodiments when considered in conjunction with the accompanying drawings.

BRIEF DESCRIPTION OF THE DRAWINGS

FIG. 11 is a plan view, with parts broken away, of a modification of the wrapper of the embodiment of FIG. 1;

FIG. 12 is a perspective view, similar to FIG. 2, showing the modified wrapper of FIG. 11 during attachment to a book;

FIG. 13 is a plan view of a transparent cover sheet for use with the book covers according to the present invention;

FIG. 24 is a perspective view of yet another embodiment of the book cover according to the present invention;

FIG. 25 is a perspective view showing a book provided with a book cover according to FIG. 24.

DESCRIPTION OF THE PREFERRED EMBODIMENTS

Figure 1:
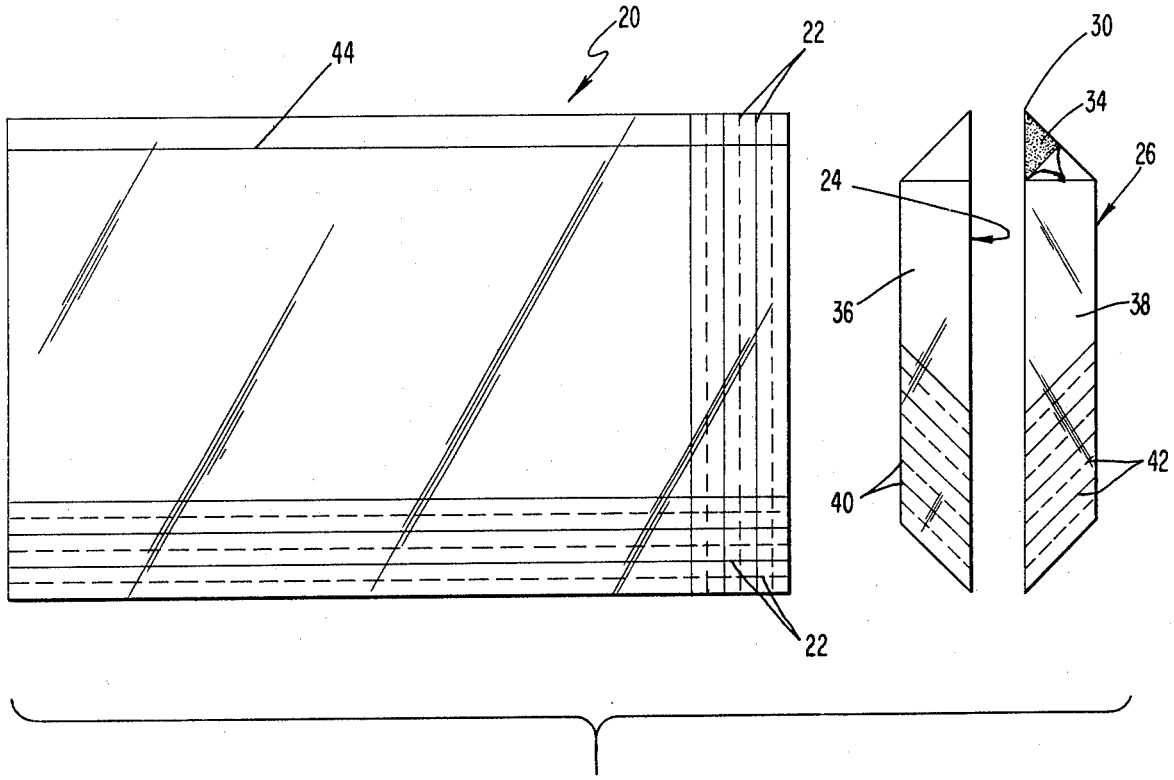
FIG. 1 is a plan view of a first embodiment of book covering apparatus according to the present invention.

Referring to FIG.1, the book cover according to the present invention includes a cover or wrapper 20 formed of a generally rectangular sheet of material which is provided on at least one side and along one longitudinal edge with a plurality of continuous and discontinuous lines 22. As will be described in more detail below, the wrapper 20 may be either transparent or opaque and may be made of any suitable natural or artificial material having on its outer surface any desired colors and/or patterns.

The book cover apparatus of the present invention also includes a pair of leaflets 24 and 26. Each of the leaflets has a height greater than the height of the book to be covered and a width less than the width of the book cover. Preferably, each of the leaflets 24 and 26 is trapezoidal in shape which, as will be appreciated below, provides for an aesthetically pleasing appearance of the covered book. Each of the two leaflets is constructed in the identical fashion and is formed in mirror image as shown in FIG. 1. Leaflets 24, 26 include an opaque or transparent outer sheet 28, 30 which is preferably provided with a pressure sensitive adhesive 32, 34. The adhesive may be applied to the entire inner surface of the leaflet sheet 28, 30 or may be provided only on the portions adjacent the top and bottom ends. A backing sheet 36, 38 covers the adhesive and is provided with a plurality of continuous and discontinuous lines 40, 42.

Figure 2:
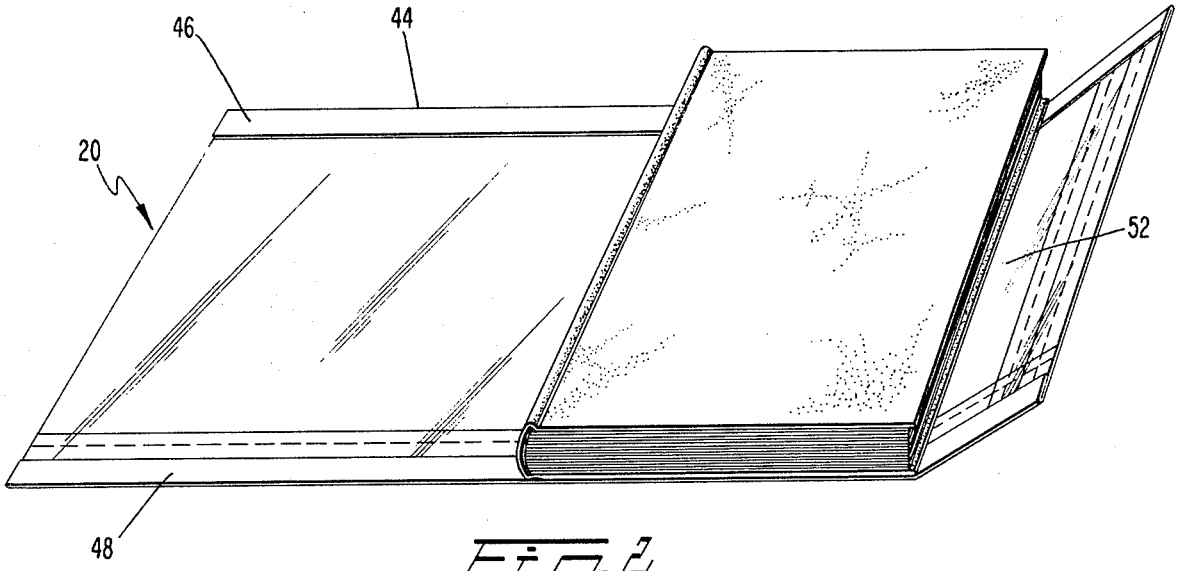
FIG. 2 is a perspective view of the outer wrapper of the apparatus of FIG. 1 prior to attachment to a book to be covered.

The book cover of FIG. 1 may be readily applied to books of varying dimensions in accordance with the method of the present invention. Turning now to FIG. 2, the first step in covering a book is to use the continuous and discontinuous lines 22 of the wrapper 20 to cut or fold the wrapper so that it accurately conforms to the height of the book. While not required, it is preferred that the longitudinal edges of the wrapper 20 be provided with finished edges. To this end, the sheet 20 may be provided with a fold line 44 to provide a fold down flap 46 as shown in FIG. 2. The bottom of the wrapper thereafter may be cut along one of the lines 22 to leave a similar margin which then may be folded up to form a second flap 48. Once the height of the wrapper is accurately conformed to the height of the book, the overall length of the wrapper may be similarly corrected. Preferably, the overall length of the wrapper will be such that it will wrap completely around the book leaving top and bottom end flaps 50 and 52 adjacent the front and back covers of the book, respectively.

Figure 3:
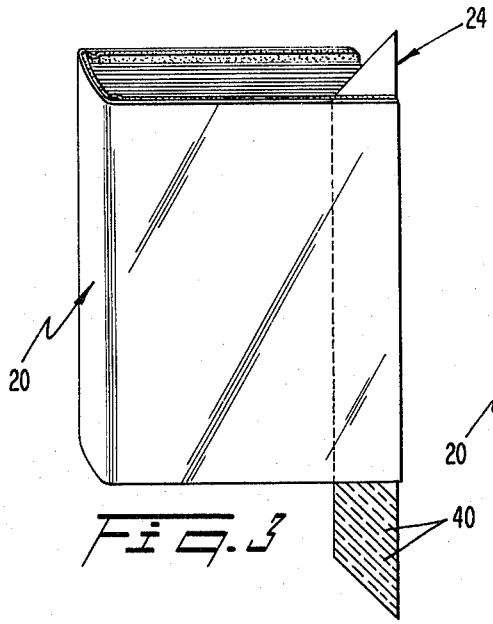
FIGS. 3–8 are perspective views showing a preferred embodiment of a method of book covering, using the apparatus of FIG. 1, according to the present invention.

After the outer wrapper 20 has been cut and folded to the correct size, and the flaps 50 and 52 have been temporarily folded under the covers of the book, the leaflets may be readily positioned. Referring to FIG. 3, it can be seen that the front leaflet 24 is first positioned between the book cover and the first page of the book so that the triangular upper tip thereof protrudes from the top of the book as shown.

Figure 4:
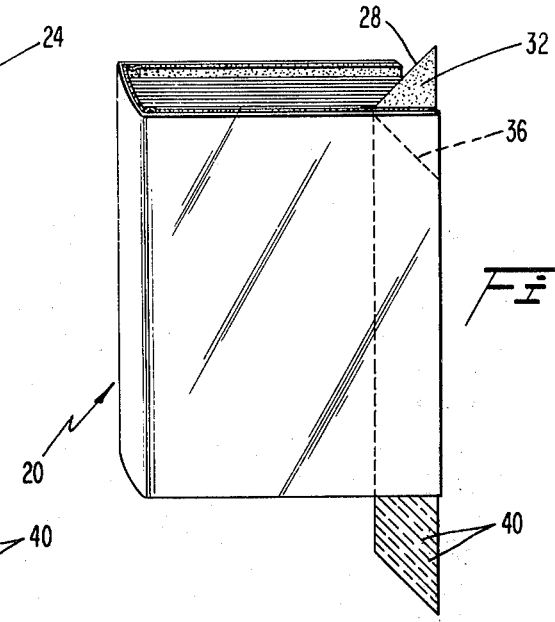

In FIG. 4, the next step is illustrated to show that the paper backing 36 is peeled away from the protruding triangular portion to expose the adhesive 32 on the outer leaflet sheet 28. The portion of the backing which has been peeled away may be tucked behind the wrapper as shown.

Figure 5:
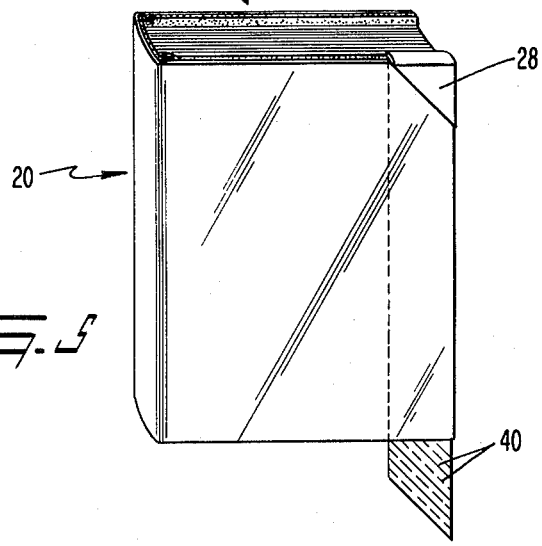

In FIG. 5, it can be seen that the exposed upper end of the leaflet outer sheet 28 is then folded down over the book cover and onto the outer surface of the front cover portion of wrapper 20. The leaflet 24 is thus, at this point, securely attached to the wrapper 20, with the lower portion of the leaflet remaining free.

Figure 6:
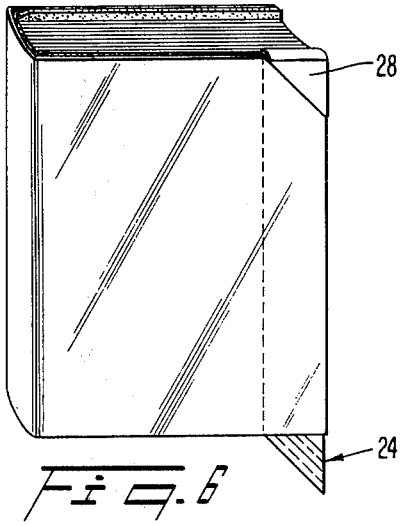
Figure 7:
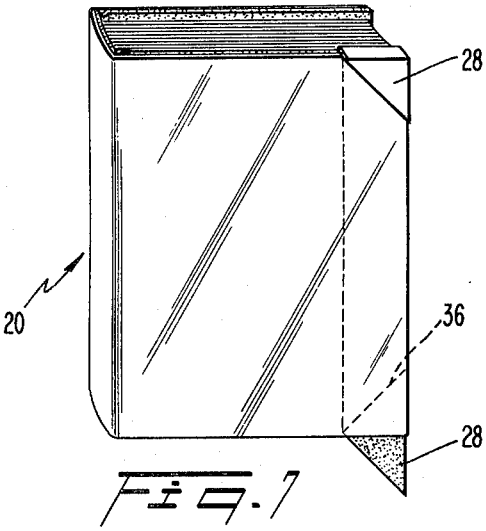
Figure 8:
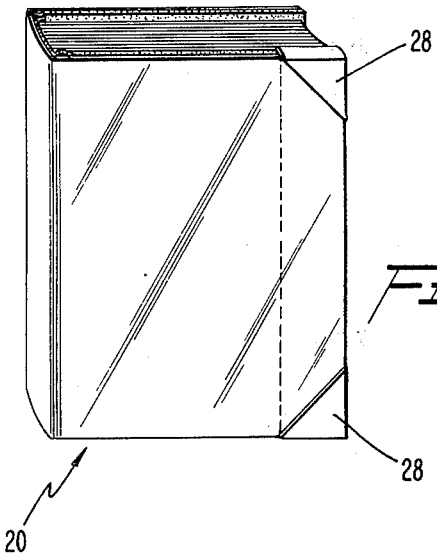

As can be readily appreciated by a comparison between FIGS. 5 and 6, the continuous and discontinuous lines 40 provided at the lower end of the leaflet 24 provide a quick and accurate means of allowing the leaflet to be precisely trimmed to conform to the height dimension of the book to be covered. By selecting the appropriate line 40, the leaflet may be trimmed as shown in FIG. 6 to provide a triangular shaped tab or ear having dimensions which are precisely the same as the tab or ear at the top of the leaflet. In FIG. 7 the paper backing 36 has ben peeled away from the protruding tab and tucked under the wrapper 20 and in FIG. 8, the leaflet has been folded up over the book cover and pressed onto the outer surface of the wrapper.

The above procedures are then repeated for the rear cover of the book using the mirror image leaflet 26.

Figure 9:
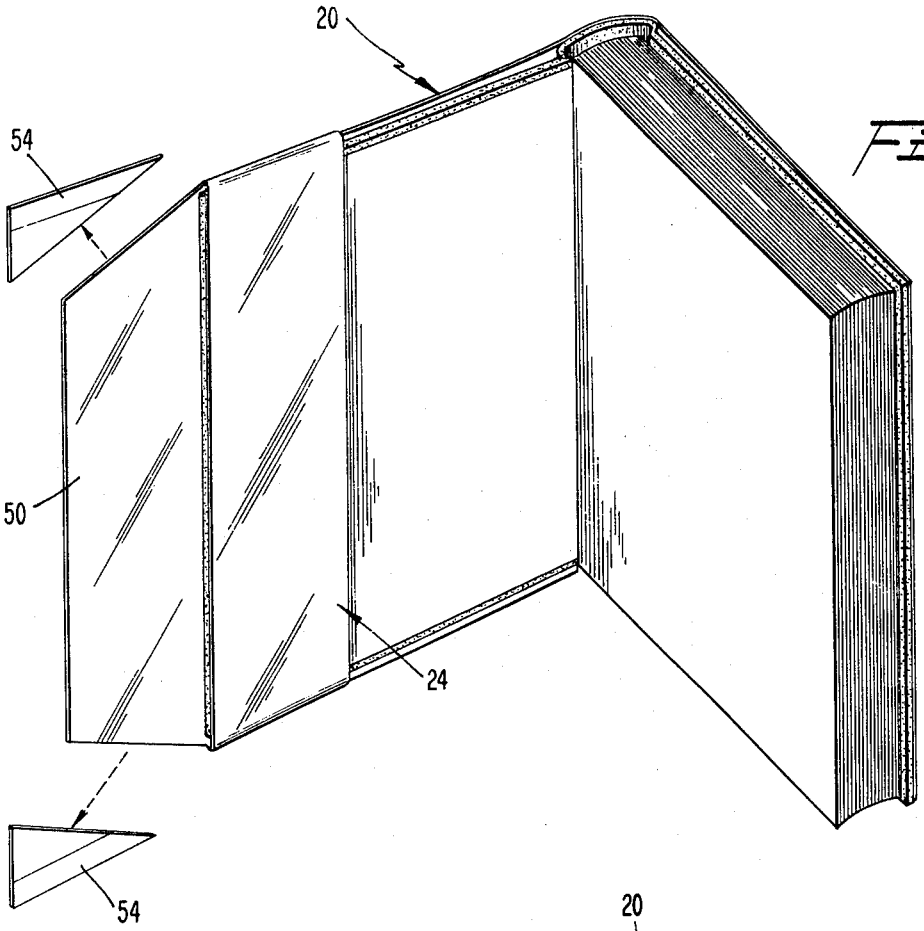
FIGS. 9 and 10 are perspective views showing further steps in accordance with the method of FIGS. 3–8 of the present invention.
Figure 10:
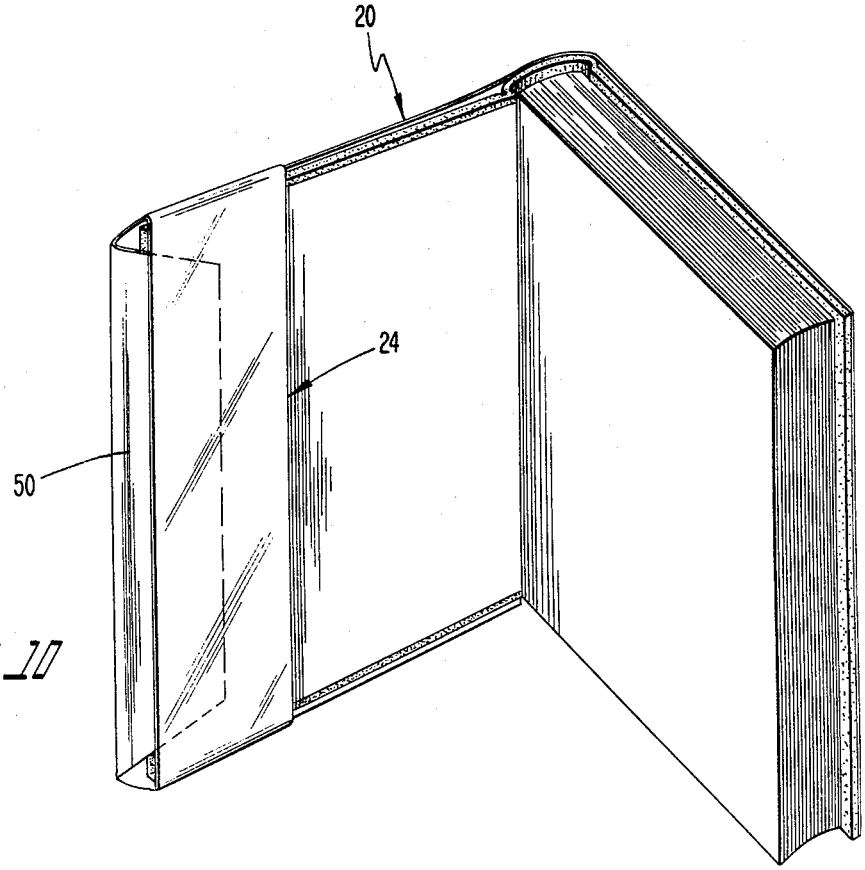

Referring to FIGS. 9 and 10, two additional finishing steps are illustrated according to the method of the present invention. In FIG. 9, the book which has been covered in accordance with the method illustrated in FIGS. 3–8, is opened to expose the front flap 50. The flap is then trimmed by making angled cuts at each end to remove triangular portions 54 and then the flap is tucked under the leaflet 24 as shown in FIG. 10. Again, the procedure is repeated with respect to the flap 52 at the back of the book to complete the procedure.

It should be appreciated that the wrapper 20 according to the present invention may be provided with any appropriate pattern of cutting lines 22 including several of the other patterns illustrated and described with respect to the embodiments described below. Furthermore, the wrapper 20 may be formed of opaque or transparent material and may consist of a single sheet or plural sheets of material, as desired. The wrapper also may be formed as a transparent pocket having a fold along a horizontal or vertical edge, a weld or bonded seal along opposite and/or adjacent edges, and an opening along a remaining edge to receive a design sheet or a location sheet, as desired. The leaflets 24 and 26 also may be made of either opaque or transparent material. Further, while the trapezoidal shape of the leaflets is preferred, any other appropriate shape may be selected, as desired, such as the generally rectangular shape illustrated and described with respect to the embodiment of FIG. 24.

Referring now to FIGS. 11 and 12, a modified wrapper 120 is illustrated. This wrapper takes the form of a pocket having inner and outer transparent sheets 122 and 124, respectively. The inner and outer transparent sheets are formed by folding a single sheet along the upper longitudinal edge or by suitably bonding two separate sheets together along both upper and lower longitudinal edges. The transparent pocket is designed to acommodate a locating sheet 126 which is provided with suitable continuous and discontinuous cutting lines 128. In operation, when conforming the height of the wrapper to that of the book to be covered, a cut is first made through both inner and outer sheets parallel to and spaced a preselected distance from the bonded top longitudinal edge. This distance is preferably greater than the height of the book by a fixed amount. Thereafter, the inner sheet 122 is cut along a line parallel to the bonded top longitudinal edge at a distance therefrom which is precisely that of the height of the book so as to expose a strip 130 along the bottom of the outer sheet 124. As shown in FIG. 12, this strip thereafter may be folded up over the inner sheet 122 whereupon the transparent pocket will conform precisely to the height of the book and will have finished edges at both the top and bottom thereof.

The opaque inner sheet 126 contained within the pocket may be discarded after the wrapper is conformed to the book height thereby providing a transparent protective cover for the book. Alternatively, the opaque sheet may be provided with a decorative design and may be retained within the pocket. Further, the sheet 126 may be removed and replaced with another opaque or translucent decorative sheet, as desired.

Once the modified wrapper 120 shown in FIGS. 11 and 12 is cut to the height of the book, the remaining steps outlined in FIGS. 3–10, above, then may be followed in the same manner as disclosed with respect to the first embodiment.

Figure 14:
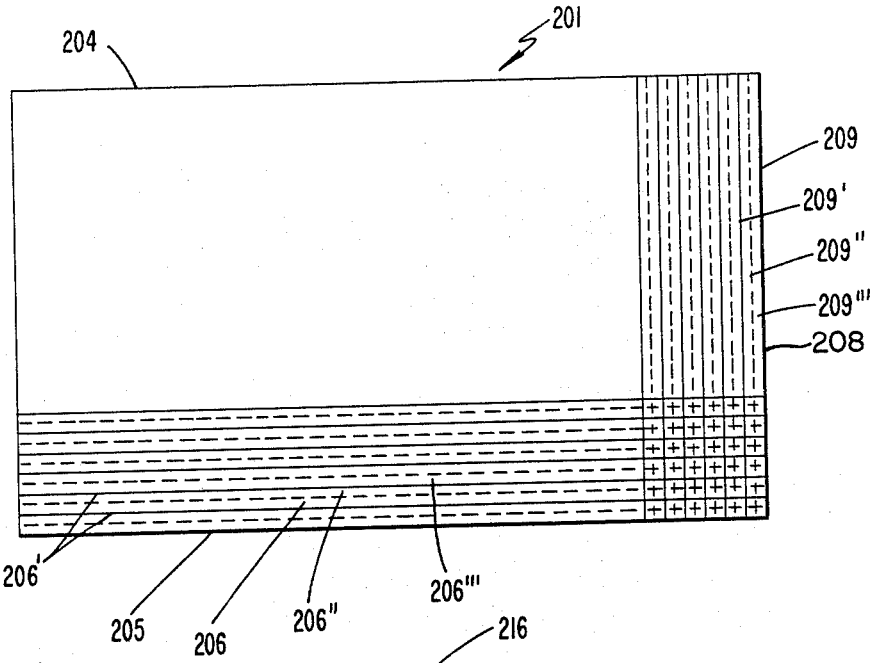
FIG. 14 is a plan view of a location sheet, to be thrown away after use, which is another part of the apparatus of the present invention.
Figure 16:
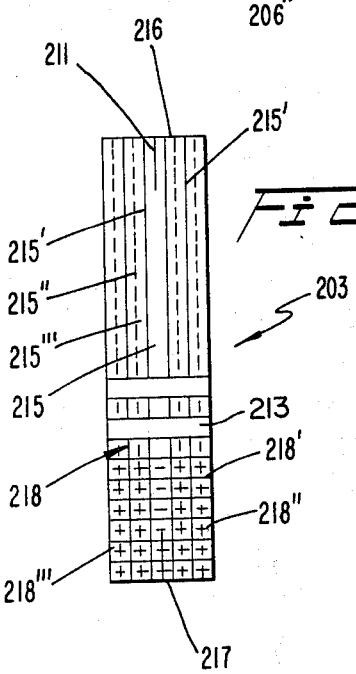
FIGS. 15 and 16 are plan views which show, respectively, the front side and back side of a spine strip to be used with the elements of FIGS. 13 and 14 in accordance with the present invention.
Figure 15:
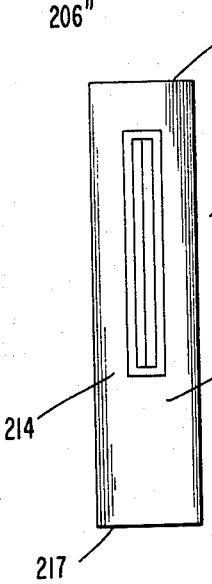

FIG. 14 shows a location sheet 201 which together with the transparent pocket cover sheet 202 of FIG. 13, the spine strip 203 illustrated in FIGS. 15 and 16, and a pair of leaflets (such as those shown in FIG. 1) forms a unit for use in constructing a transparent book cover or jacket.

The location sheet 201 is a sheet of opaque paper, to be thrown away after utilization, which presents along one of its longitudinal edges 204 and 205, e.g., its inferior edge 205, a series of horizontal parallel lines 206, some of which 206′ being continuous lines and the others 206″ being broken lines, the spaces between these lines being noted 206‴. The continuous lines 206′ are spaced from one another by about 0.5 cm., with the distance between a line 206″ in broken lines and the nearest line 206′ in continuous line being about 0.25 cm. These lines and interlines are used to locate exactly the measures of the height of the books, which heights can vary between, e.g., about 16 to about 23 cm.

The location sheet 201 also presents, at a certain distance to its lateral right edge 208 a series of vertical parallel lines 209, some of which 209′ are continuous lines and the others 209″ are broken lines, the lines 209′ and 209″ being separated by the interlines 209‴. The spaces between the lines 209′, and between lines 209″ and the adjacent lines 209′ are respectively about 1 cm. to 0.5 cm. and about 0.5 cm. to 0.25 cm. The spaces given are non-restrictive examples.

The cover sheet 202 shown in FIG. 13 preferably is a transparent pocket formed by folding a transparent sheet at edge 220 and bonding adjacent and opposite edges 220′ and 220″, respectively, leaving the top edge 221 open to receive the location sheet 201. This cover sheet can be made of any suitable material, such as cellophane or plastic.

FIGS. 15 and 16 show, respectively, the spine strip with front view 212 and a back view 213. On the front side 212, (shown as a mounted book cover) the spine strip can be decorated with ornamental designs coordinated with the thickness and the height of a book, even when the spine strip has been cut to the desired size; in an alternate embodiment, a lengthwise frame for holding a label can be employed (not shown) to indicate the title of the book and the author. Instead of a label, the frame 214 can directly indicate a manuscript or typewritten inscription showing the title of the book and/or the name of the author. The frame should be situated at a midpoint in the thickness and the height of the spine strip. Ornamental guiding marks can be provided to permit a correct alignment of the letters of the inscription.

On the back side 213 of the spine strip there is a series of vertical parallel lines 215, some of which 215′ are continuous lines and the others 215″ are broken lines, these lines being separated by interlines 215‴. In like manner, along its superior edge 216 and/or inferior edge 217, the spine strip is provided, on its back side 213, with a series of horizontal parallel lines 218, some of which 218′ are continuous lines and the others 218″ are broken lines, the interlines noted by 218‴. The spaces between the lines 215 and the lines 218, which have the same functions as the lines 206 and 209, are the same as those indicated hereinabove for lines 206.

The spine strip 203 shown in FIGS. 15 and 16 is made of an opaque material, e.g., paper, imitation leather, leather or plastic and can be of any color; for example, green, white, red, golden or silver.

Figure 17:
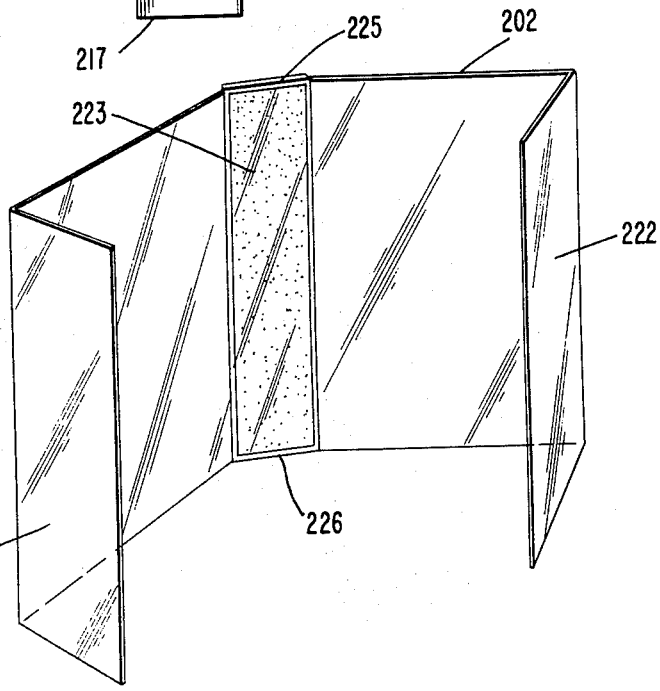
FIG.17 is a perspective view showing the cover sheet of FIG. 1, cut, centered and folded to the size of a book and detached from the location sheet of FIG. 2.

To cover a book with a book cover or jacket while using the elements of the unit shown in the FIGS. 13 to 16 one can proceed as follows:

First, insert the location sheet into the transparent pocket and, laying the book thereover, measure exactly the height, the width and the thickness of the book to be covered. Apply the measures on the location sheet, while identifying the vertical lines 209′ or 209″ or interlines 209‴ and the horizontal lines 206′ or 206″ or interlines 206‴, which correspond respectively to the width-plus-thickness and the height of the book. Then cut the location sheet and the pocket along the lines 206′ or 206″ or interlines 206‴ and, at a chosen distance from the edge 220″, along the lines 209′ or 209″ or interlines 209‴. Next, open the pocket at fold 220 to obtain a transparent cover sheet with flaps 222 which can be folded as shown in FIG. 17. One can cut the correct size (height and width) for the spine strip 203, by using the vertical location lines 215′ or 215″ or interlines 215‴ to determine the width and the location lines 218′ or 218″ or interlines 218‴ to determine the height.

After fixing the spine strip 203 on the cover sheet 202, fold the cover sheet to obtain a draft of a cover as shown in FIG. 17.

When, as in the embodiment shown in FIG. 14, the over sheet is transparent or translucent, the location sheet 201 can only be used to locate exactly the sizes of the book cover and the center of the spine strip. The location sheet is thrown away after use as described hereinabove. The cover, as now prepared, can then be attached to the book using the leaflets as described above with respect to FIGS. 3–10.

The cover sheet 202 and the spine strip 203 can be attached in different ways as described hereinafter.

One can position the spine strip 203, on its front side 212 or back side 213 with an adhesive coating by using a pressure sensitive adhesive, so that the visible side 212 of the spine forming the spine of the book cover can be glued to the correct location on the cover sheet 202 and to the desired size when the back 213 of the spine strip 203 is glued to the spine of the book. In FIG. 17 a spine strip 203 is shown with one of its sides having a self-adhesive coat which is protected until use by a release sheet or a removable protective sheet.

As indicated above, the spine strip can be glued directly on the surface 223 of the cover sheet 202. This spine strip 203 can be glued on the front or back of the cover sheet 202. It is also clear that the spine strip can be preglued to the cover sheet 202.

Figure 18:
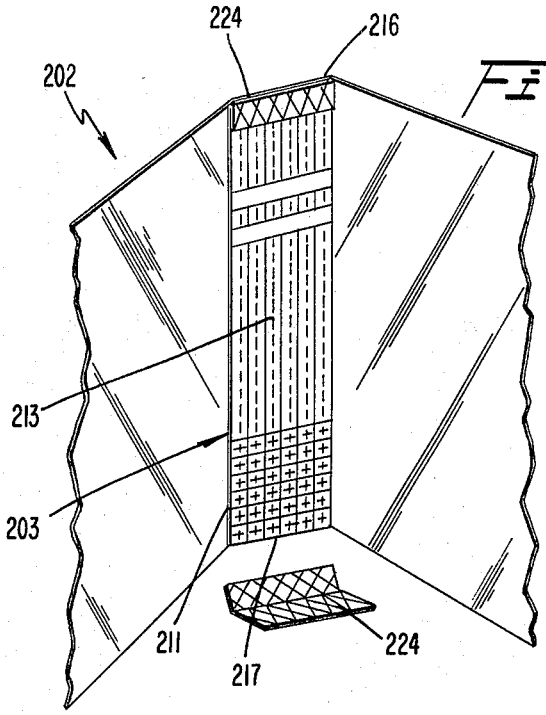
FIGS. 18 and 19 are perspective views showing the attachment of a spine strip to a cover sheet according to the present invention.

FIG. 18 shows a spine strip 203 pre-attached to the back side of the transparent cover sheet 202. The means of attachment is two labels, one of which is pre-fixed; these labels 224 can be transparent and self-adhesive or provided with a pressure sensitive coat on one or both sides. These labels 224 can have the form of a dihedral as shown in FIG. 18. One-half of one of the label 224 has been glued to the spine strip 203, along its superior edge 216 and the other half on the cover sheet. The spine strip 203 must be cut where necessary along the selected lines 215. The other label 224 should be fixed to the spine strip and to the cover sheet after being folded over the inferior edge 226 of the portion 223 forming the spine of the cover. Instead of providing a spine strip pre-attached to the cover sheet 202 by a label, it is clearly possible to employ two free labels and glue the spine strip to the cover sheet 202 along both the superior edge 216 and the inferior edge 217.

Figure 19:
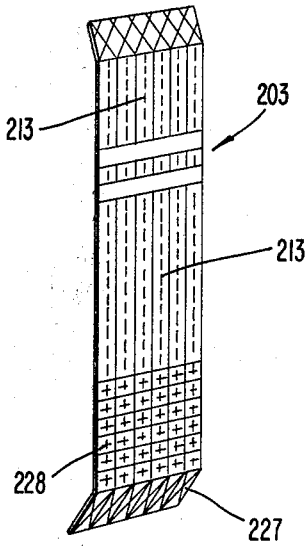

In FIG. 19, the spine strip 203 is provided on its back side with self-adhesive tape to form a flap 227 articulated at each of the edges 216 and 217 of the spine strip.

When using the location lines, the horizontal 218′ or 218″ or interlines 218‴ and the vertical 215′ or 215″ or interlines 215‴, the spine strip is cut to the desired size. One of the flaps 227 of the spine strip subsists while the other has been taken off from the spine strip by the cutting of the spine strip along the chosen line 218′ or 218″ or interline 218‴. From the portion of the spine strip which has been cut off, a part of the adhesive tape is recovered and used to attach the inferior edge of the spine strip to the cover sheet 202. This spine strip 203 is then attached to the cover sheet along its edges 216 and 217.

Figure 20:
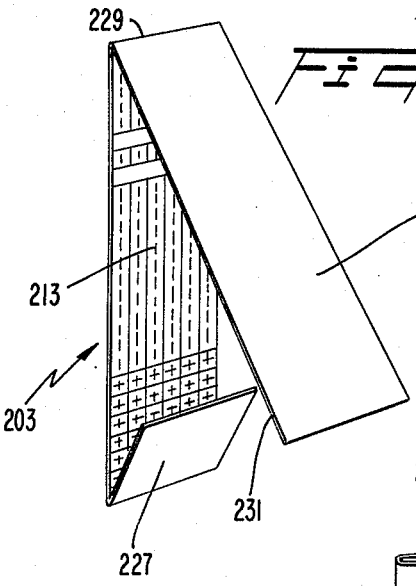
FIG. 20 is a perspective view of another embodiment of a spine strip according to the present invention.

In FIG. 20, the spine strip 203 is articulated in 229 to a support strip 230. This support strip can be coated on the side facing the back 213 of the spine strip 203 with a self-adhesive sensitive to pressure. In this embodiment the cover sheet 202 is merely slipped into the desired position determined by the angle formed by the spine strip 203 and the support strip 230. Thereafter, the support strip can be affixed to the cover sheet 202 and to the flap 227 of the spine strip so that they can be bounded together.

As an alternative to providing an adhesive coat on one of the support strip sides 230, one can, after having interposed the cover sheet 202 between the spine strip 203 and the support strip 230, utilize a label 224 or a flap 227 which is glued on the side of the support strip 230.

Figure 21:
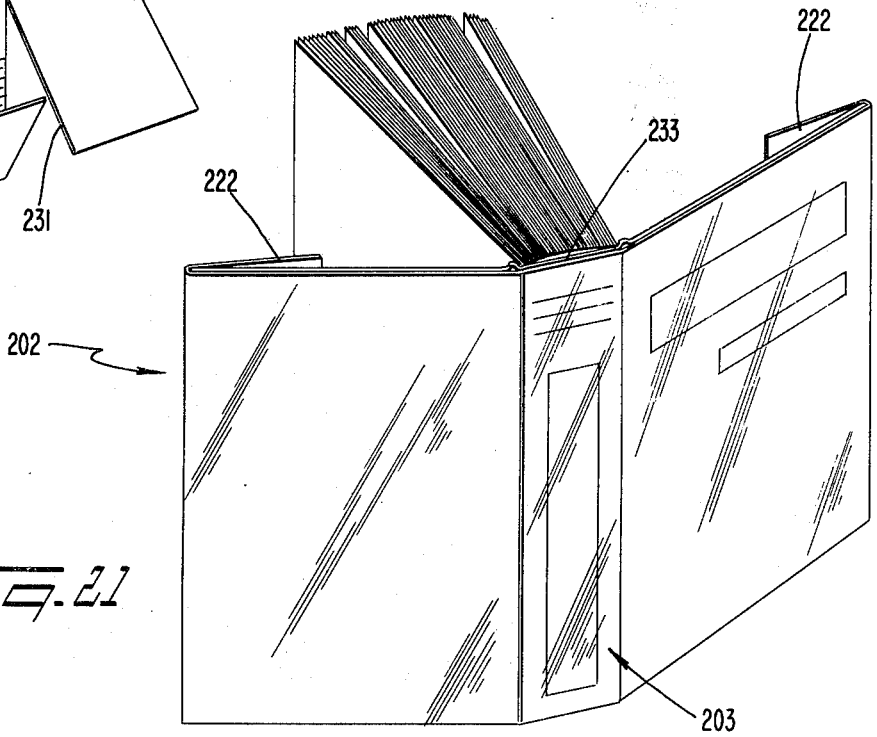
FIG. 21 is a perspective view showing a book provided with a book cover fabricated from the elements of the preceding FIGS. 13–20.

FIG. 21 shows a jacket or book cover made up of elements described above and mounted on a book 232. In this embodiment the spine strip 203 extends outside the cover sheet 202. It is clearly possible to operate so that this spine strip extends inside the cover sheet 202, that is between the spine 233 of the book 232 and the portion 223 of the cover sheet 202 which covers the spine 233.

When, as shown in FIG. 21, the spine strip 203 extends outside the cover sheet 202, it can be protected by a protection sheet or supplementary cover sheet which is equally transparent, and is cut out from the cover sheet 202 and applied upon the outside surface of the cover sheet 202. The cover sheet 202 and the protection sheet can be welded together along the vertical left and/or right edges.

Figure 22:
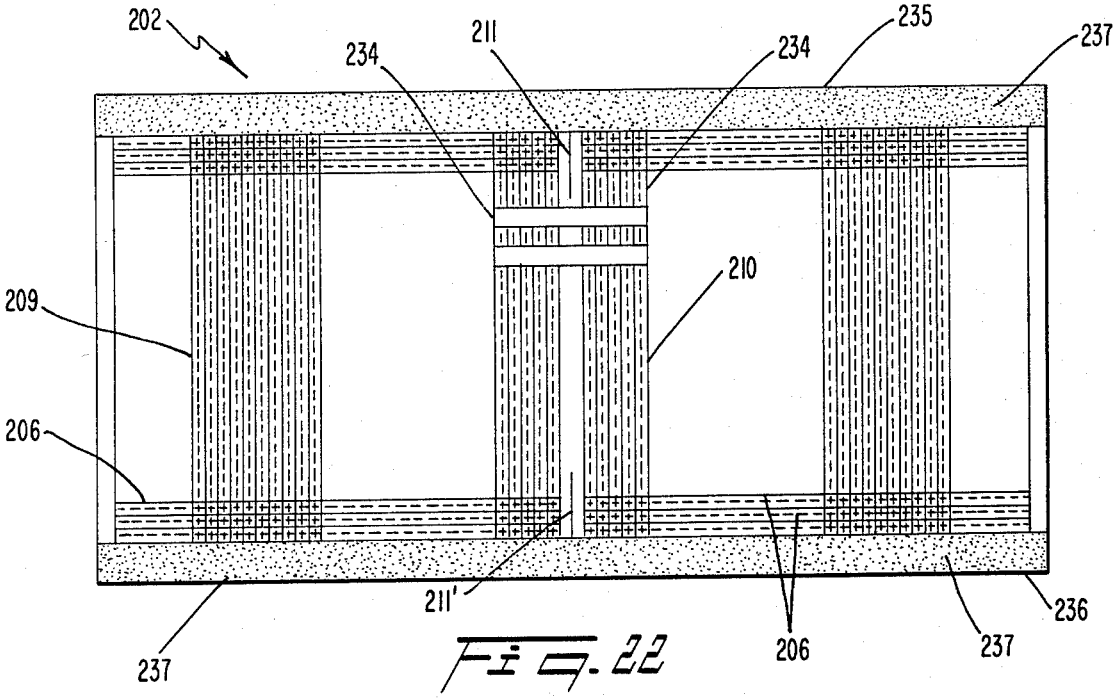
FIG. 22 is a plan view of the inner side of an opaque cover sheet according to the present invention.

In FIG. 22, there is shown an opaque cover sheet 202, made of, e.g., imitation leather, plastic material or strong paper. This cover sheet 202 is provided with location lines like those on the location sheet 210 of FIG. 14, i.e., the horizontal 206 and the vertical lateral 209, as well as a set of vertical central lines 210. Moreover, the cover sheet 202 shown in FIG. 22 is provided along its superior edge 235 and/or inferior edge 236 with a self-adhesive tape 237, which can be removable. On the side opposite the side having the lines 206, 209 and 210 and the self-adhesive tapes, the cover sheet 202 is decorated with designs. Decorations are also arranged on the portions which form the spine of the cover and on the portions which cover the front pages of the book to be covered. These designs are cut or folded without affecting the decorative aspect of the cover. Since the location means are on the back, a location sheet like the one shown in FIG. 14 is not necessary.

Figure 23:
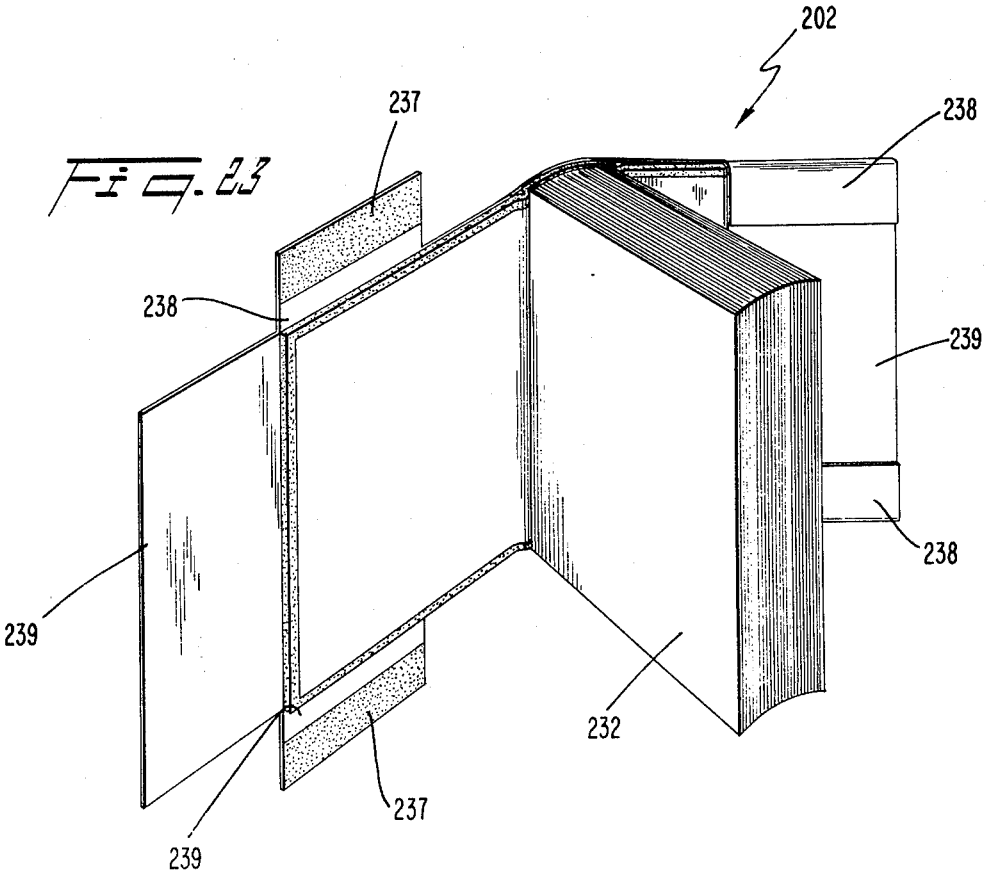
FIG. 23 is a perspective view of a book wrapped in an opaque book cover obtained from the cover sheet of FIG. 22.

After folding the cover sheet 202 of FIG. 22 to obtain a draft of a book cover similar to the one shown in FIG. 17, it is possible to obtain a book cover as shown in FIG. 23, by folding the longitudinal superior and inferior flaps 238 inwardly to the front page of the book 232, and folding the lateral flaps 239 of the cover sheet 202, which have also been cut out and folded over. The second way to cover a book using the sheet of FIG. 22 is to fold the longitudinal superior and inferior edges inwardly to the cover sheet so as to form two folded edges similar to those and 46 and 48 in FIG. 2. Next, the superior and inferior edges of the end flaps 239 are folded, after making a small vertical cut at the fold line, over the outside of the wrapper sheet and are affixed thereto. Since the self-adhesive tape is removable, the cover can be cut to whatever height is necessary and the end flaps, acting as incorporated leaflets, can be attached at the exact height required. Thus, it can be appreciated that the self-adhesive tapes 237 will be cut to form a middle piece, for holding the folded superior and inferior edges and maintaining them in a finished manner, and end pieces for attaching the end flaps 239—acting as leaflets—to the outer surface of the wrapper sheet.

In FIG. 24, there is shown a unit comprising an opaque cover sheet 202 like the one of FIG. 22, an interpolated or intermediate sheet 240 glued at 253 to the cover sheet 202 and two rectangular leaflets 241 which can be transparent. On the back portion which is provided with location lines 206, 209, 211 and 210, the cover sheet can have lateral self-adhesive coats 242. The interpolated sheet 240 presents the same location lines as those of the cover sheet. Like the leaflets 241 they are provided with a self-adhesive coat 243 or with a double-coated self-adhesive tape along the upper and lower edges.

FIG. 25 shows how the elements of FIG. 24 are put together to form the cover of a book 232. After having cut and prefolded the cover sheet 202 and the interpolated sheet 240 according to the desired measures, while using the location lines 206, 209, 211 and 210 drawn on the frong of the interpolated sheet 240 as well as possibly the location lines drawn on the back of the cover sheet 202, the two sheets 202 and 240 are applied on the book, as shown in FIG. 25; thereafter, after folding (as shown in 244) the upper and lower edges and fixing the adhesive tapes 243 on the back of the interpolated sheet 240, the two leaflets 241 are fitted and fixed to the back of the interpolated sheet 240. The leaflets 241 which are fixed in this way form loops 245 in which the lateral flaps 239 and 246 of the sheets 202 and 240 can be slipped as shown chain-dotted in 247.

The self-adhesive coats 242 on the back of the cover sheet 202, along the lateral edges are used to affix flaps 239 and 246 which are then slipped into the loops 245. The book cover obtained is characterized by a great solidity and a fine finish.

Figure 26:
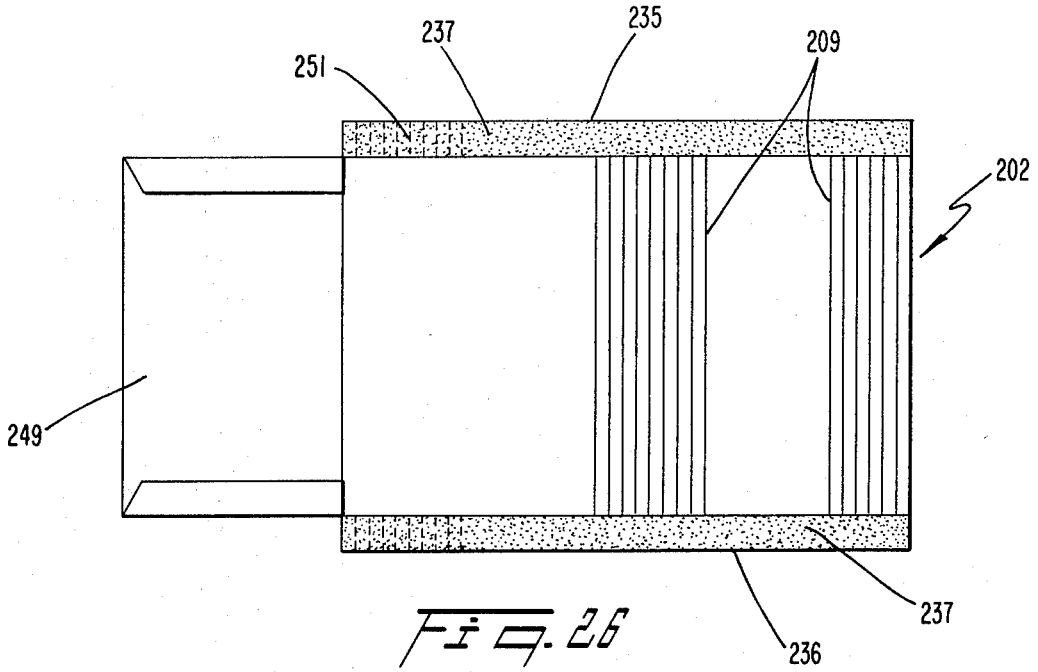
FIGS. 26 and 27 are plan and perspective views, respectively, of a further embodiment of a book cover according to this invention.
Figure 27:
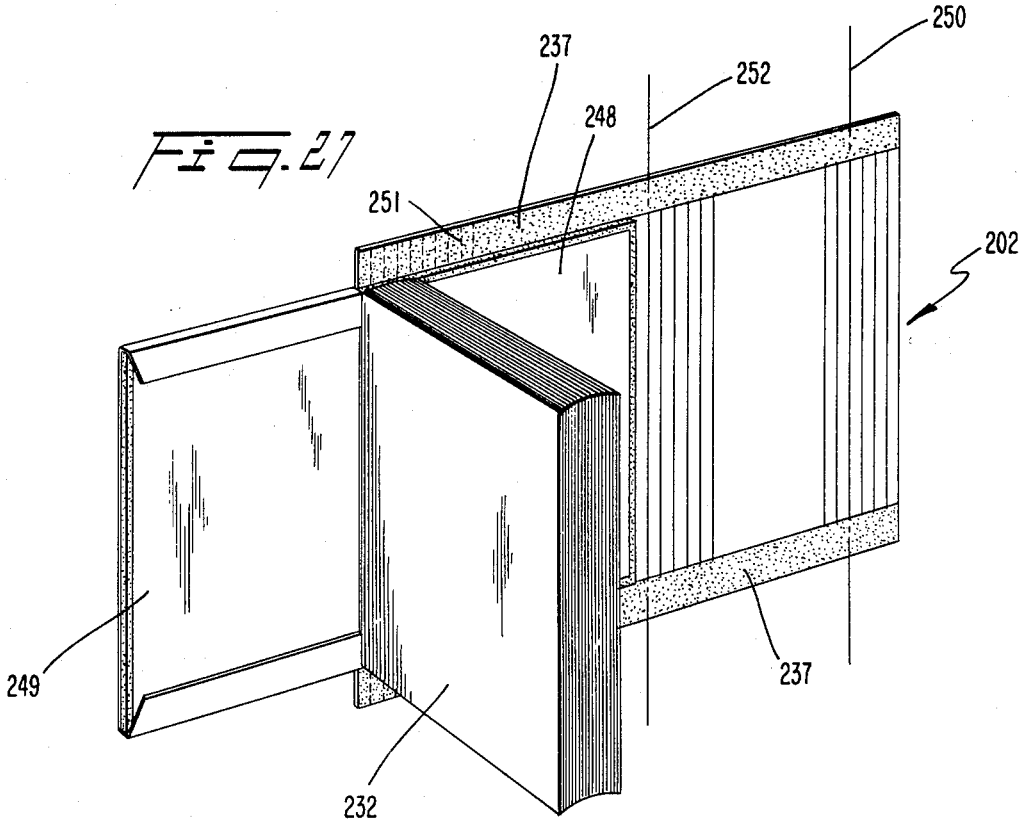

FIGS. 26 and 27 shown an embodiment of a more elaborate book cover according to the present invention. In this case, the cover sheet forms one piece with a pocket 249 to receive the front or the back of a book 232. Moreover, the cover sheet 202 has location lines 209, as well as two adhesive bands 237 extending respectively along the upper edge 235 and the lower edge 236.

After being fitted to the book 232 as shown in FIG. 27, the cover sheet is merely cut to the length desired in 250, thereafter the upper and lower edges of the cover sheet are cut to the width of the spine as in 251; afterwards, the cover sheet is folded along the line 252 after the upper and the lower adhesive bands have been cut;

the cover sheet is folded inwardly over the back 248 of the book. In folding inwardly over both the remaining adhesive bands 237 a pocket is obtained, which is similar to pocket 249. Alternatively, the cut end flap can be folded over the outer wrapper and affixed as in FIG. 22.

The above-mentioned adhesive coats can be directly applied on their support or can be made of a self-adhesive tape that has glue on both sides. The use of such self-adhesive tape is very advantageous as it permits movement of the tapes to the desired positions.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A method for covering a book comprising the steps of:

conforming a generally rectangular wrapper to the height of the book, said wrapper enveloping the book so as to leave two end flaps;

folding the end flaps over the front and rear cover, respectively, of the book;

placing a first leaflet between the front cover of the book and the first page thereof, said leaflet having a height exceeding that of the book and a width inferior to that of the book;

positioning the leaflet adjacent the proximal end of the front end flap such that portions of the leaflet protrude beyond the top and bottom edges of the book cover;

bending the protruding portions of the leaflet over the top and bottom edges, respectively, of the book cover and adhering said bent portions to the outer surface of said wrapper so as to form a loop on the inside of the book cover;

tucking said front end flap under said loop; and repeating the above steps with respect to a second leaflet to be affixed to the rear cover of the book.

2. A method as recited in claim 1, wherein said leaflet is trapezoidal in shape and wherein said positioning step comprises positioning said leaflet with the longer longitudinal edge thereof adjacent the proximal end of the end flap.

3. A method as recited in claim 2, wherein said leaflet is provided with a series of cutting lines parallel to an inclined edge thereof and wherein the method comprises, before said bending steps, the step of cutting of said leaflet along one of said lines so that the shorter longitudinal edge of said leaflet is equal to the height of the book.

4. A method as recited in claim 1, wherein said wrapper is an opaque sheet of material provided with a series of parallel lines on an inner surface thereof, and wherein said conforming step comprises the step of cutting said wrapper along one of said lines.

5. A method as recited in claim 1, wherein said wrapper comprises a pocket formed of inner and outer transparent sheets bonded along at least one longitudinal edge, and wherein said conforming step comprises the steps of cutting both of said transparent sheets parallel to said bonded edge at a distance therefrom which exceeds the height of the book by a preselected amount, cutting the inner transparent sheet parallel to said bonded edge at a distance therefrom equal to the height of the book so as to expose a strip of said outer transparent sheet, and folding said exposed strip over said inner transparent sheet.

6. A method as recited in claim 5, wherein said conforming step further comprises the step of placing a sheet of material having a series of parallel lines imprinted thereon inside said pocket to facilitate said cutting steps.

7. A method as recited in claim 1, wherein said wrapper comprises a transparent sheet of material folded in half upon itself at a fold line and bonded together along one edge adjacent said fold line and along one edge opposite said fold line to form a pocket; a location sheet provided with a series of parallel lines imprinted thereon, said sheet being inserted into said pocket whereby said lines may be used as cutting guide lines; and wherein said conforming step comprises the steps of cutting said pocket parallel to said adjacent bonded edges to conform to the height of the book and cutting said pocket parallel to said opposite bonded edge to conform to the width and thickness of the book.

8. A method as recited in claim 1, wherein said leaflets are coated with an adhesive protected by a backing sheet, and wherein said bending step comprises peeling said backing sheet away from the protruding portions of said leaflet, folding the peeled backing sheet under the cover portion of the wrapper, and adhering the protruding portions of the leaflet against the outer surface of the cover portion of the wrapper.

9. A method as recited in claim 1, further comprising, before said tucking step, the step of cutting said end flaps angularly along the longitudinal edges thereof so that the flap may be easily received under said loop.

10. An apparatus for covering a book comprising:

a generally rectangular wrapper having a front cover portion and a rear cover portion connected by spine portion and further having front and rear end flaps extending from said front and rear cover portions, respectively;

two discrete leaflets each having a height exceeding that of the book and a width inferior to that of the book, each of said leaflets being disposed inside a respective cover of the book with ends protruding above and below the book covers; and means to attach the protruding ends of each of said leaflets to the outer surface of said front and rear cover portions, respectively, of the wrapper adjacent the proximal edge of said end flaps to form loops inside the book covers for receiving said end flaps and for securely affixing the wrapper on the book without direct attachment thereto.

11. Apparatus as set forth in claim 10 wherein said wrapper is transparent.

12. Apparatus as set forth in claim 10 wherein said wrapper is opaque.

13. Apparatus as set forth in claim 10 wherein said rectangular wrapper comprises two transparent sheets of material attached along at least one longitudinal edge to form a hollow pocket.

14. Apparatus as set forth in claim 13 wherein said rectangular wrapper further comprises a paper liner inserted between said transparent sheets, and wherein said liner is provided, along at least one edge, with a series of parallel lines to facilitate cutting of the wrapper to conform to the dimensions of the book.

15. Apparatus as set forth in claim 10 wherein said leaflets are rectangular in shape.

16. Apparatus as set forth in claim 10 wherein said leaflets are trapezoidal in shape with the longer longitudinal edge located adjacent the proximal end of said end flaps.

17. Apparatus as set forth in claim 15 or 16 wherein said leaflets are transparent.

18. Apparatus as set forth in claim 15 or 16 wherein said leaflets are opaque.

19. Apparatus as set forth in claim 10 wherein said leaflet attachment means comprise a layer of adhesive on at least a portion of each of said leaflets, each adhesive layer being protected by a removable backing paper.

20. Apparatus as set forth in claim 19 wherein said backing paper is provided, at least at one end of said leaflet, with a series of parallel lines to facilitate cutting of the leaflet to conform to the height of the book.

21. Apparatus as set forth in claim 10 wherein said rectangular wrapper comprises at least two rectangular sheets attached at said spine portion; and wherein said leaflets are attached to the outer surface of the inside one of said two rectangular sheets.

22. Apparatus as set forth in claim 10, further comprising an opaque spine strip, and means to attach said spine strip to said spine portion of said wrapper.

23. Apparatus as set forth in claim 22 wherein said spine strip is provided with a series of parallel lines on the back side thereof to facilitate cutting of said strip to conform to the dimensions of the book.

24. Apparatus as set forth in claim 10 wherein said leaflets are cut from said wrapper and are made of the same material.

25. Apparatus as set forth in claim 10 wherein said wrapper comprises a layer of adhesive along upper and lower longitudinal edges thereof.

* * * * *